US010549536B2

(12) United States Patent
Yoshimura et al.

(10) Patent No.: US 10,549,536 B2
(45) Date of Patent: Feb. 4, 2020

(54) CARRIAGE AND RECORDING APPARATUS

(71) Applicant: SEIKO EPSON CORPORATION, Tokyo (JP)

(72) Inventors: Akihiro Yoshimura, Hokuto (JP); Kenichiro Kaneko, Okaya (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/037,575

(22) Filed: Jul. 17, 2018

(65) Prior Publication Data

US 2019/0023009 A1 Jan. 24, 2019

(30) Foreign Application Priority Data

Jul. 20, 2017 (JP) ..... 2017-140629

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/15; B41J 29/377
USPC ..... 347/20, 37, 40, 47
See application file for complete search history.

(56) References Cited

U.S. PATENT DOCUMENTS

| | | | | |
|---|---|---|---|---|
| 7,594,712 | B2 * | 9/2009 | Hasegawa | B41J 29/13 347/108 |
| 2010/0156988 | A1 | 6/2010 | Kimura et al. | |
| 2015/0273835 | A1 | 10/2015 | Arimizu et al. | |
| 2016/0236491 | A1 * | 8/2016 | Asamoto | B41J 2/1714 |
| 2018/0333971 | A1 * | 11/2018 | Sasaki | B41J 11/002 |

FOREIGN PATENT DOCUMENTS

| | | |
|---|---|---|
| JP | 2010-162873 A | 7/2010 |
| JP | 2015-193219 | 11/2015 |

* cited by examiner

*Primary Examiner* — An H Do
(74) *Attorney, Agent, or Firm* — Workman Nydegger

(57) ABSTRACT

Provided is a carriage including a head including a nozzle surface, the nozzle surface including nozzles configured to eject ink droplets, and a plasma actuator configured to apply an air current flowing along the nozzle surface.

9 Claims, 10 Drawing Sheets

CARRIAGE AND RECORDING APPARATUS

BACKGROUND

1. Technical Field

The disclosure relates to a carriage and a recording apparatus.

2. Related Art

Ink jet-type recording apparatuses are in wide use. In an ink jet-type recording apparatus, ink is ejected from nozzles as ink droplets, and positions where the ink droplets land are controlled. Then, a predetermined pattern is drawn with the ink droplets. There is demand for shortening time taken for printing to improve convenience. Further, the number of ink droplets ejected per unit of time is increased to accelerate drawing.

A plurality of nozzles are provided in a nozzle head, and a plurality of the nozzle heads are provided in a carriage. Then, the carriage moves parallel to a printing medium. Ink droplets are ejected simultaneously from the plurality of nozzles. Then, when the ink droplets travel from the nozzles toward the printing medium, an air current is generated as the ink droplets travel. This air current is turbulence and a form of the current varies. Then, when the air current affects a travel direction of the ink droplets, the ink droplets land in positions distant from intended positions. When the landing positions deviate in this manner, darkness inconsistency called ripples is generated.

JP-A-2010-162873 discloses a method for preventing such ripples. According to this method, a nozzle plate is provided with nozzles and protrusions each having a prismatic shape and extending parallel to a nozzle row, and the protrusions are provided on the side of the nozzle row. These protrusions prevent occurrence of vortices, and thus, prevent occurrence of ripples.

In JP-A-2010-162873, the nozzle plate is provided with the nozzles and the protrusions. This configuration is effective when there is a low ink droplet discharge rate. However, when there is a high ink droplet discharge rate to increase a drawing speed, vortices generated in a nozzle arrangement direction result in a variation in the landing positions of the ink droplets. Therefore, there is demand for a carriage capable of preventing ink droplets landing on a recording medium from forming a ripple-like pattern.

SUMMARY

According to the disclosure, the following aspects or application examples can be realized.

Application Example 1

A carriage according to Application Example 1 includes a head including a nozzle surface, the nozzle surface including nozzles configured to eject ink droplets, and at least one plasma actuator configured to apply an air current flowing along the nozzle surface.

According to Application Example 1, the carriage includes the head and the plasma actuators. The head include the nozzle surface provided with the nozzles, and the ink droplets are ejected from the nozzles. The plasma actuators apply the air current to a first air current flowing along the nozzle surface.

When the ink droplets ejected from the nozzles travel, an air current is generated and travels parallel to the ink droplets travel. This air current will be referred to as a second air current. As an ejection rate of the ink droplets increases, turbulence is generated in the second air current in the peripheries of the ink droplets. The turbulence in the second air current disturbs a travel direction of the ink droplets. When the ink droplets are affected by the turbulence in the second air current, the ink droplets landing on a recording medium form a ripple-like pattern.

The plasma actuators apply the air current further to the first air current flowing along the nozzle surface. The first air current affects the turbulence in the second air current traveling in the travel direction of the ink droplets, and prevents the turbulence in the second air current occurring in the peripheries of the ink droplets from stagnating. Accordingly, the ink droplets traveling can be prevented from being affected by the turbulence in the second air current. As a result, the carriage can prevent the ink droplets landing on the recording medium from forming a ripple-like pattern.

Application Example 2

In the carriage according to the above-described application example, the nozzles may be arranged in a second direction intersecting with a first direction in which the carriage travels, and the nozzles may constitute a nozzle row, and places where the nozzles are not provided at the nozzle row and the ends of the nozzle row may be included within a range where the plasma actuators apply the air current in the second direction.

According to Application Example 2, the carriage travels in the first direction. Then, the nozzles are arranged in the second direction intersecting with the first direction, and constitute the nozzle row. Accordingly, the nozzle row extends in the second direction. The plasma actuators are longer in the second direction than the nozzle row. Then, the nozzle row is located within the range where the plasma actuators apply the air current to the first air current. Further, the place where the nozzles are not provided at the ends of the nozzle row is also located within the range where the plasma actuators apply the air current to the first air current.

The plasma actuators apply the air current to the first air current in a place where the nozzle row is provided. Further, the plasma actuators also apply the air current to the first air current in the places where the nozzles are not provided at the ends of the nozzle row. For this reason, the first air current can flow at the ends of the nozzle row as quickly as in the middle of the nozzle row. As a result, also at the ends of the nozzle row the ink droplets traveling can also be prevented from being affected by the turbulence in the second air current, as with in the middle of the nozzle row.

Application Example 3

In the carriage according to the above-described application example, the carriage may move back and forth in the first direction, and plasma actuators may be disposed to sandwich the head in the first direction, and the plasma actuators disposed on a side toward which the carriage travels relative to the head may apply the air current to the head.

According to Application Example 3, the carriage moves back and forth in the first direction. When the carriage travels, the first air current travels from the travel direction side of the carriage to the head. And, the plasma actuators are disposed to sandwich the head in the first direction. The plasma actuators disposed on the side toward which the carriage travels relative to the head are different in a forward path and a return path in which the carriage travels. Then, the plasma actuators disposed on the side toward which the carriage travels relative to the head apply the air current to the head. Accordingly, during the movement of the carriage in the forward path and also in the return path, therefore the head can be passed through the air current applied by the plasma actuators in a direction identical to a travel direction of an air current generated as the carriage travels.

Application Example 4

The carriage according to the above-described application example may further include a main body unit configured to support the head and the plasma actuators, and at least one of a plurality of concave portions or a plurality of convex portions may be disposed on an air current surface that is a surface on which a gas flows along the nozzle surface in the main body.

According to Application Example 4, the carriage includes the main body unit configured to support the head and the plasma actuators. The air current surface is a surface on which a gas flowing along the nozzle surface flows in the main body. At least either the plurality of concave portions or the plurality of convex portions are disposed on the air current surface. Some of the air current flowing along the air current surface flows along the concave portions or the convex portions, and also some of the air current travels straight. In this case, the air current flowing along the concave portions or the convex portions and the air current traveling straight interfere each other and generate fine turbulence. Fluid body resistance in the air current surface can be reduced by this turbulence. As a result, the first air current can flow efficiently.

Application Example 5

In the carriage according to the above-described application example, the air current surface may include: a first region in which at least either the plurality of concave portions or the plurality of convex portions are disposed, and second regions in which neither the concave portions nor the convex portions are disposed. The second regions may be disposed to sandwich the first region in the second direction intersecting with the first direction in which the carriage travels, and the nozzles may be provided in the first region.

According to Application Example 5, the main body unit of the carriage includes the first region and the second regions. At least either the plurality of concave portions or the plurality of convex portions are disposed in the first region. Then, neither the concave portions nor the convex portions are disposed in the second regions. Thus, the first air current flows more efficiently in the first region than in the second regions.

Then, the second regions are disposed to sandwich the first region in the second direction intersecting with the first direction in which the carriage travels. When the carriage travels in the first direction, a direction in which the first air current flows can be so controlled that the first air current flowing in the first region flows into the first direction without flowing toward the second regions.

The nozzles are provided in the first region. Accordingly, it is possible the first air current flowing in the first region to pass along the nozzle surface efficiently.

Application Example 6

In the carriage according to the above-described application example, the main body unit may include a current introducing portion configured to guide the air current flowing along the nozzle surface in the first direction in which the carriage travels.

According to Application Example 6, the main body unit is provided with the current introducing portion in the first direction in which the carriage travels. Then, the current introducing portion moves air located on the side corresponding to the direction in which the carriage moves. Then, the moved air becomes the first air current flowing along the nozzle surface. Accordingly, the current introducing portion can take in the first air current efficiently as the carriage travels.

Application Example 7

A recording apparatus according to this application example may include the above-described carriage.

According to Application Example 7, the recording apparatus includes the above-described carriage. The above-described carriage is a carriage capable of preventing ink droplets landing on a recording medium from forming a ripple-like pattern. Accordingly, the recording apparatus can be implemented as a recording apparatus including a carriage capable of preventing ink droplets landing on a recording medium from forming a ripple-like pattern.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
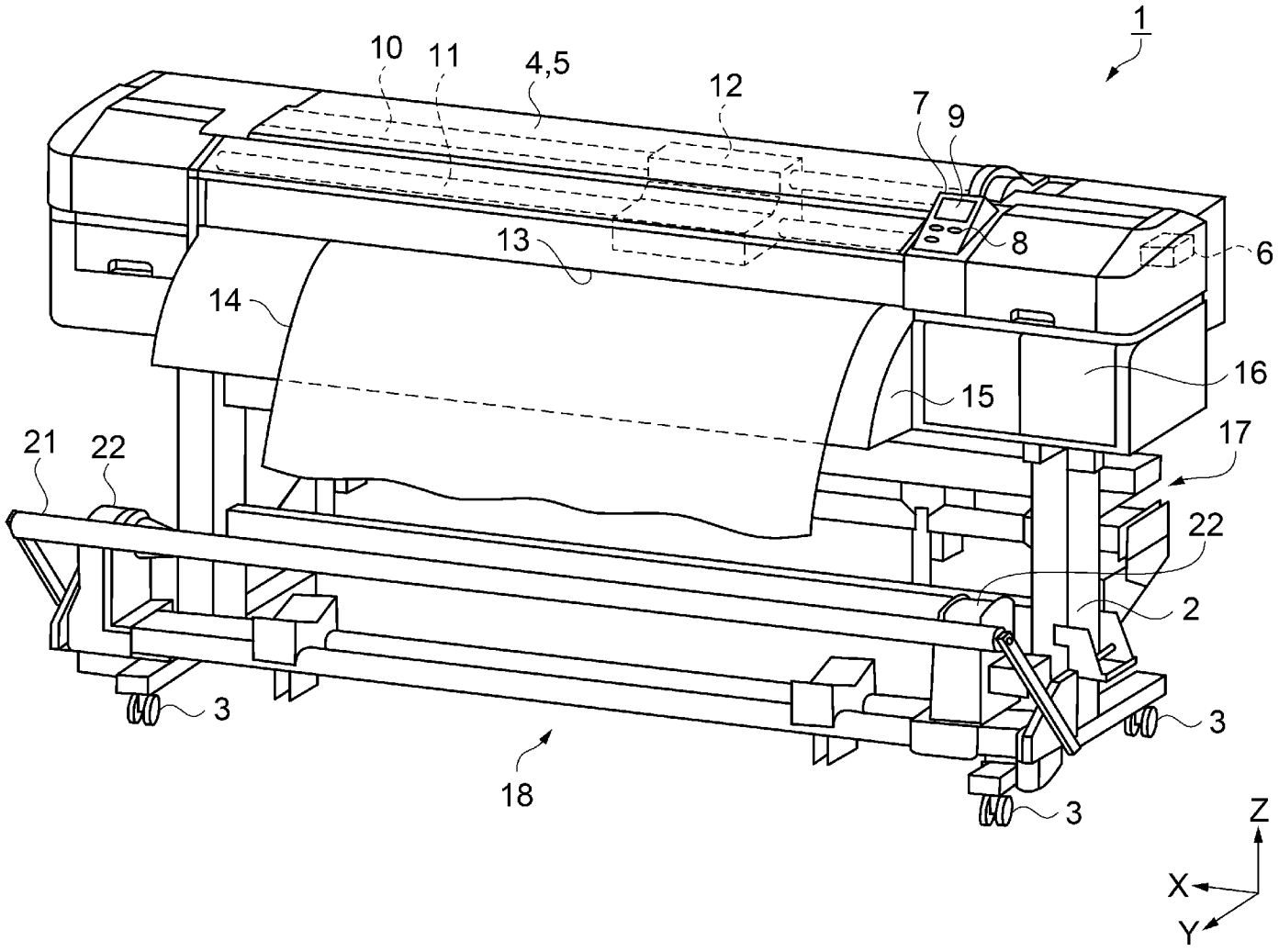
FIG. 1 is an overall perspective view illustrating a structure of a recording apparatus.

Some exemplary embodiments will be described hereinafter with reference to the drawings. Note that elements in the drawings are illustrated at different scales for each element to illustrate the elements at recognizable sizes in the drawings.

First Exemplary Embodiment

A first exemplary embodiment will describe an example of a recording apparatus with reference to the drawings. The recording apparatus according to the first exemplary embodiment will be described with reference to FIGS. 1 to 16. FIG. 1 is an overall perspective view illustrating a structure of the recording apparatus. As illustrated in FIG. 1, a recording apparatus 1 is a roll-to-roll type large-format ink jet printer configured to handle a recording medium comparatively large. The recording apparatus 1 has a shape longer in one direction along the ground. A lengthwise direction of the recording apparatus 1 corresponds to an X-axis direction, and a left side in FIG. 1 corresponds to a +X-axis direction. A direction orthogonal to the X-axis direction along the ground corresponds to a Y-axis direction. A direction of gravitational acceleration corresponds to a −Z-axis direction.

The recording apparatus 1 includes legs 2. Wheels 3 are provided on the −Z-axis direction sides of the legs 2, and the recording apparatus 1 is movable. The wheels 3 are each provided with a locking function (not illustrated), and the wheels 3 are prevented from rotating when the recording apparatus 1 is in use. A housing unit 4 is provided on the +Z-axis direction sides of the legs 2, and a printing unit 5 and a control unit 6 configured to control the recording apparatus 1 are provided inside of the housing unit 4.

An operation panel 7 is provided on the +Z-axis direction side and the −X-axis direction side of the housing unit 4. The operation panel 7 includes an operation unit 8 and a display unit 9. The operation unit 8 includes a push-type switch and the like. An operator operates the operation unit 8 when the operator inputs printing conditions and the like and makes various types of instructions. The display unit 9 includes a liquid crystal display device and the like. A printing condition setting screen and the like are displayed in the display unit 9.

A guide rail 10, a guide rail 11, and a carriage 12 are provided in the printing unit 5. A head (not illustrated) configured to eject ink as ink droplets is provided in the carriage 12. The guide rail 10 and the guide rail 11 extend in the X-axis direction, and the carriage 12 travels along the guide rail 10 and the guide rail 11.

A discharge port 13 is provided on the +Y-axis direction side of the housing unit 4, and a recording medium 14 discharged by the printing unit 5 is discharged from the discharge port 13. A downstream side support unit 15 is provided on the −Z-axis direction side of the discharge port 13. The downstream side support unit 15 guides the recording medium 14 discharged from the discharge port 13. An ink attachment unit 16 is provided on the −X-axis direction side of the downstream side support unit 15. Ink is housed in the ink attachment unit 16.

A medium feed section 17 is provided on the −Y-axis direction sides of the legs 2. The medium feed section 17 supplies the recording medium 14 to the printing unit 5. A medium take-up section 18 is provided on the +Y-axis direction sides of the legs 2. The medium take-up section 18 takes up the recording medium 14 discharged from the discharge port 13. The medium take-up section 18 includes a tension roller 21 and second holders 22. The tension roller 21 includes a rod-shaped member extending in the X-axis direction, and applies constant tension to the recording medium 14. Thus, the tension roller 21 prevents wrinkling from occurring in the recording medium 14. The second holders 22 take up and hold the recording medium 14 in a cylindrical shape.

Figure 2:
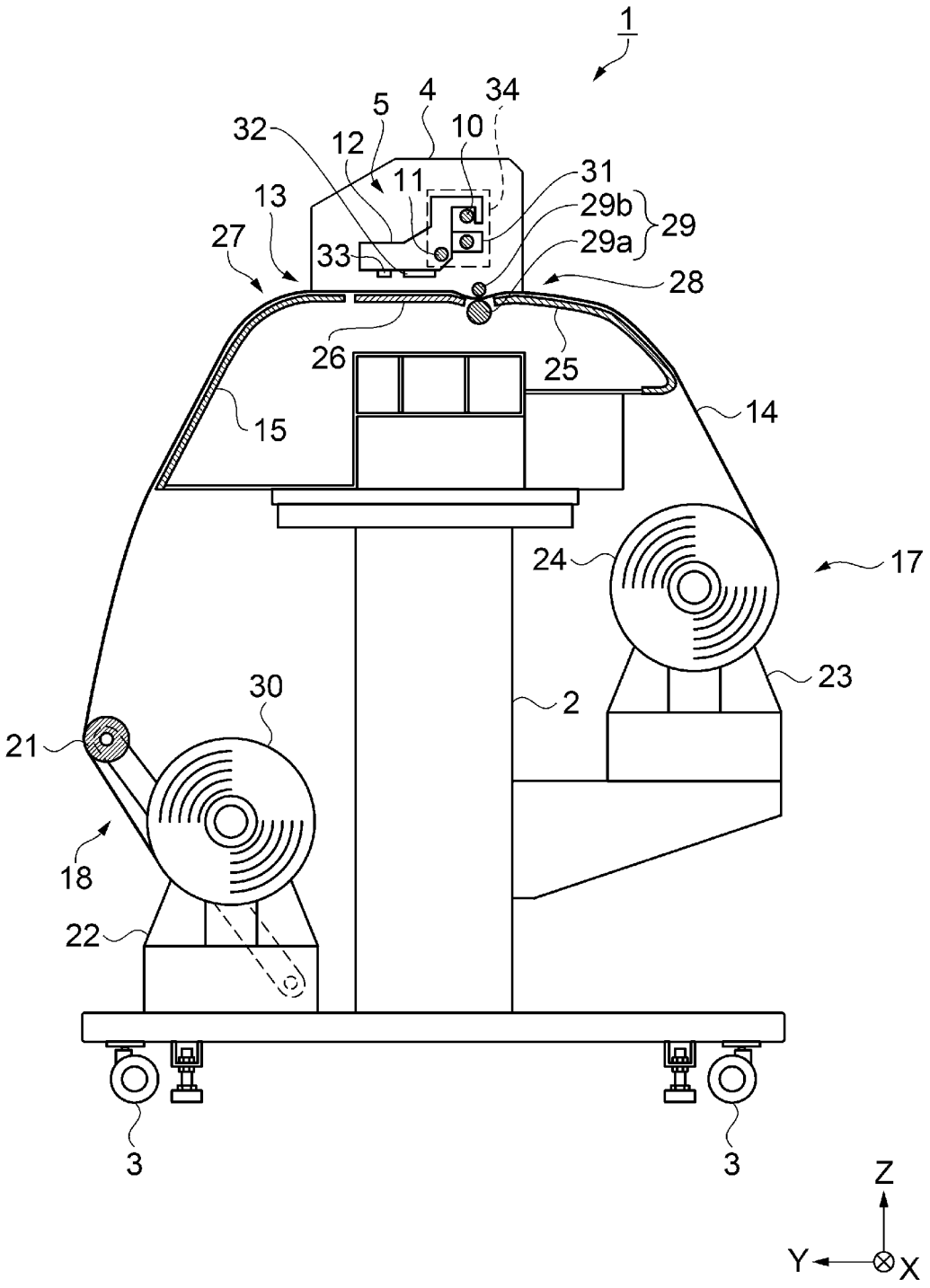
FIG. 2 is a schematic side cross-sectional diagram illustrating the structure of the recording apparatus.

FIG. 2 is a schematic side cross-sectional diagram illustrating the structure of the recording apparatus. As illustrated in FIG. 2, the medium feed section 17 includes a first holder 23. Then, the first holder 23 holds a first roll body 24 in which the recording medium 14 unused is wound in a cylindrical shape. The medium feed section 17 includes a motor (not illustrated). Then, the medium feed section 17 rotates the first roll body 24 in a counter-clockwise direction with the X-axis direction being as an axis. Thus, the recording medium 14 is supplied from the first roll body 24 to the printing unit 5. Note that types of the recording medium 14 broadly include a paper type and a film type. Specific examples of the recording medium 14 of the paper type include woodfree paper, cast coated paper, art paper, and coat paper, and specific examples of the recording medium 14 of the film type include synthetic paper, polyethylene terephthalate (PET), and polypropylene (PP).

An upstream side support unit 25, a platen 26, and the downstream side support unit 15 are provided in this order from the −Y-axis direction side toward the +Y-axis direction side between the housing unit 4 and the legs 2. The upstream side support unit 25, the platen 26, and the downstream side support unit 15 guide the recording medium 14. Then, the upstream side support unit 25, the platen 26, and the downstream side support unit 15 constitute a transport path 27 of the recording medium 14.

A supplying port 28 is provided between the upstream side support unit 25 and the housing unit 4. The recording medium 14 supplied from the medium feed section 17 is guided to the supplying port 28 via the upstream side support unit 25. Transport rollers 29 are provided between the upstream side support unit 25 and the platen 26. The transport rollers 29 include a transport driving roller **29*a* and a transport driven roller 29*b*. The transport driving roller 29*a* and the transport driven roller 29*b* extend in the X-axis direction intersecting with the +Y-axis direction side corresponding to a movement direction of the recording medium 14. The transport driving roller 29*a* is disposed on the −Z-axis direction side of the transport path 27. The transport driven roller 29*b* is disposed on the +Z-axis direction side of the transport driving roller 29*a*. The transport driven roller 29*b* rotates following the rotation of the transport driving roller 29*a***.

The transport rollers 29 include a spring (not illustrated). Then, the spring presses the transport driven roller **29*b* against the transport driving roller 29*a*. In a state where the transport driven roller 29*b* is pressed against the transport driving roller 29*a*, the transport rollers 29 nip the recording medium 14 and feed the recording medium 14 to the printing unit 5** in the +Y-axis direction. A transport motor (not illustrated) configured to rotate the transport driving roller 29*a* is provided inside of the housing unit 4. The transport motor is driven to rotationally drive the transport driving roller 29*a*, and thus, the recording medium 14 nipped between the transport driven roller 29*b* and the transport driving roller 29*a* is transported in the +Y-axis direction.

The recording medium 14 having passed through the transport rollers 29 moves along the platen 26. Then, the recording medium 14 having passed through the platen 26 moves along the downstream side support unit 15. The discharge port 13 is provided between the downstream side support unit 15 and the housing unit 4. The recording medium 14 is discharged from the discharge port 13 to the outside of the housing unit 4. The recording medium 14 having passed through the discharge port 13 moves along the downstream side support unit 15 toward the medium take-up section 18.

In the medium take-up section 18, the recording medium 14 printed onto by the printing unit 5 is taken up into a cylindrical shape and formed into a second roll body 30. The second holders 22 sandwich a core member (not illustrated) to hold the core member, and the recording medium 14 is taken up onto the core member and forms the second roll body 30. One of the second holders 22 includes a winding motor (not illustrated) configured to supply rotational force to the core member. The winding motor is driven and the core member rotates. Thus, the recording medium 14 is taken up onto the core member. The tension roller 21 sags under its own weight and presses the recording medium 14 from the back surface side of the recording medium 14. Thus, the tension roller 21 applies tension to the recording medium 14.

A carriage moving unit 31 is provided inside of the housing unit 4. The carriage moving unit 31 moves the carriage 12 back and forth in the X-axis direction. The X-axis direction in which the carriage 12 moves will be referred to as a main scanning direction. The carriage 12 is supported by the guide rail 10 and the guide rail 11 disposed along the X-axis direction. Then, the carriage 12 is capable of moving back and forth in the ±X-axis directions by the carriage moving unit 31. For example, a mechanism in which a ball screw and a ball nut are combined, a linear guide mechanism, or the like can be employed as the mechanism of the carriage moving unit 31. Further, the carriage moving unit 31 is provided with a motor (not illustrated) as a power source for moving the carriage 12 along the X-axis direction. When the motor is driven under the control of the control unit 6, the carriage 12 moves back and forth along the X-axis direction.

Head units 32 serving as heads, and a reflective sensor 33 are provided in the carriage 12. The head units 32 eject ink droplets onto the recording medium 14 transported along the platen 26. The reflective sensor 33 is an optical sensor including a light source unit (not illustrated) and a light receiving unit (not illustrated). The light source unit emits light in the −Z-axis direction, the light receiving unit receives the resulting reflected light, and a detection value based on intensity of the reflected light received by the light receiving unit is output to the control unit 6. Moreover, while the carriage 12 moves in the X-axis direction, the reflective sensor 33 carries out the detection. The control unit 6 senses positions of both end portions in the X-axis direction of the recording medium 14, based on the detection value. Then, the control unit 6 calculates a length in the X-axis direction of the recording medium 14. The length in the X-axis direction of the recording medium 14 corresponds to a width of the recording medium 14. Then, according to the detected width of the recording medium 14, the head units 32 eject ink droplets onto the recording medium 14 to carry out printing.

In addition, an adjustment mechanism 34 is provided inside of the housing unit 4. The adjustment mechanism 34 is disposed at both end portions in the X-axis direction of the guide rail 10 and the guide rail 11. Then, the adjustment mechanism 34 is a mechanism configured to adjust a separation distance between the head units 32 and the recording medium 14. The adjustment mechanism 34 changes positions in the Z-axis direction of the head units 32.

Figure 3:
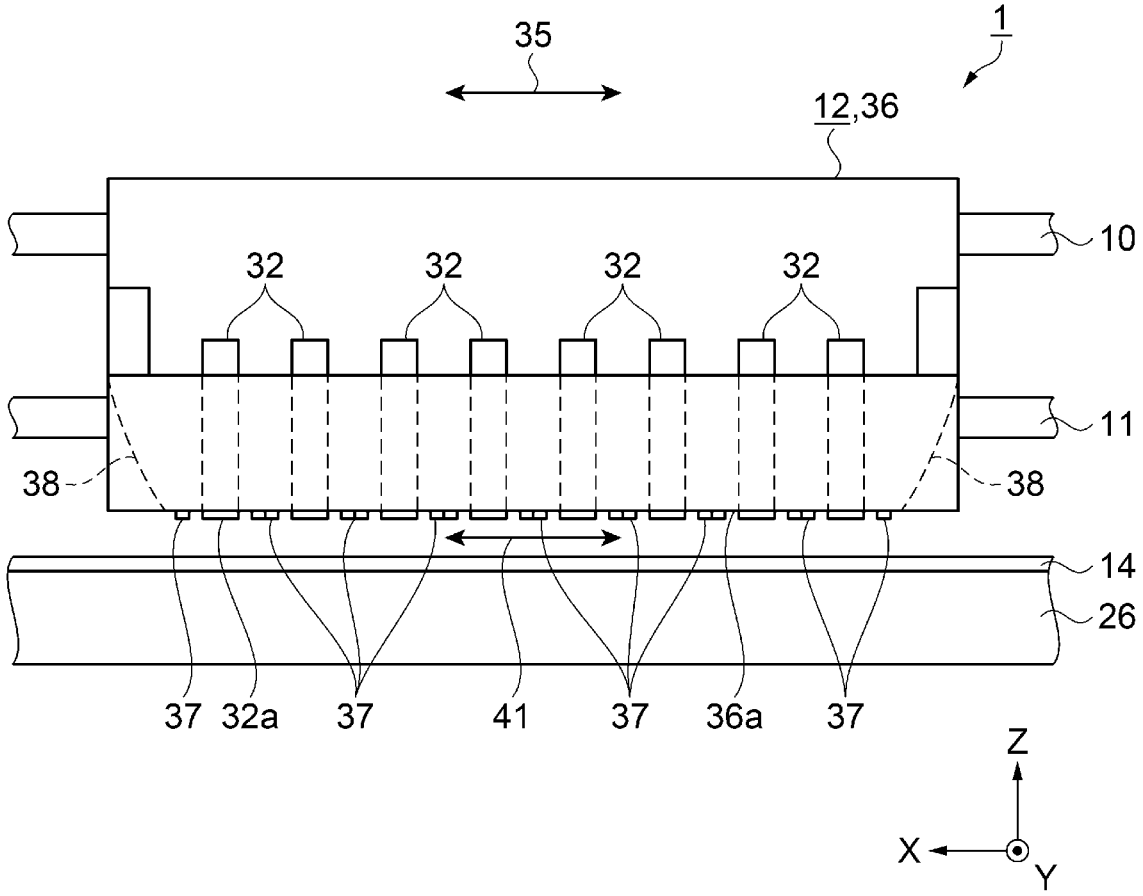
FIG. 3 is a schematic side view illustrating a structure of a carriage.

FIG. 3 is a schematic side view illustrating a structure of the carriage. As illustrated in FIG. 3, the carriage 12 moves back and forth in the X-axis direction along the guide rail 10 and the guide rail 11. The direction in which the carriage 12 moves will be referred to as a first direction 35. The carriage 12 includes a main body unit 36, and the head units 32 are provided in the main body unit 36. Although the number of the head units 32 is not particularly limited, in the first exemplary embodiment, the eight head units 32 are provided in the one carriage 12, for example. Each head unit 32 includes a nozzle surface 32*a* on the −Z-axis direction side, and nozzles configured to eject ink droplets are provided on the nozzle surface 32*a*.

Further, plasma actuators 37 are provided on a surface of the −Z-axis direction side of the main body unit 36. Then, the main body unit 36 supports the head units 32 and the plasma actuators 37. The plasma actuators 37 apply an air current flowing along the nozzle surface 32*a*. Current introducing portions 38 are provided on both sides of the main body unit 36 in the first direction 35 in which the carriage 12 moves and configured to guide the air current flowing along the nozzle surface 32*a*.

The current introducing portions 38 are deeply recessed on the nozzle surface 32*a* sides. An air current flowing along the nozzle surface 32*a* between the nozzle surface 32*a* and the recording medium 14 will be referred to as a first air current 41. When air comes into contact with the current introducing portion 38 located on a side surface of the travel direction side of the carriage 12, the current introducing portion 38 guides the air to between the nozzle surface 32*a* and the recording medium 14. Then, the air guided to between the nozzle surface 32*a* and the recording medium 14 becomes the first air current 41 flowing along the nozzle surface 32*a*. A surface of the main body 36 facing the platen 26 will be referred to as an air current surface 36*a*. The air current surface 36*a* is a surface on which a gas flowing along the nozzle surface 32*a* flows. Since the current introducing portions 38 are recessed on the nozzle surface 32*a* sides, the first air current 41 is taken in efficiently as the carriage 12 moves.

Figure 4:
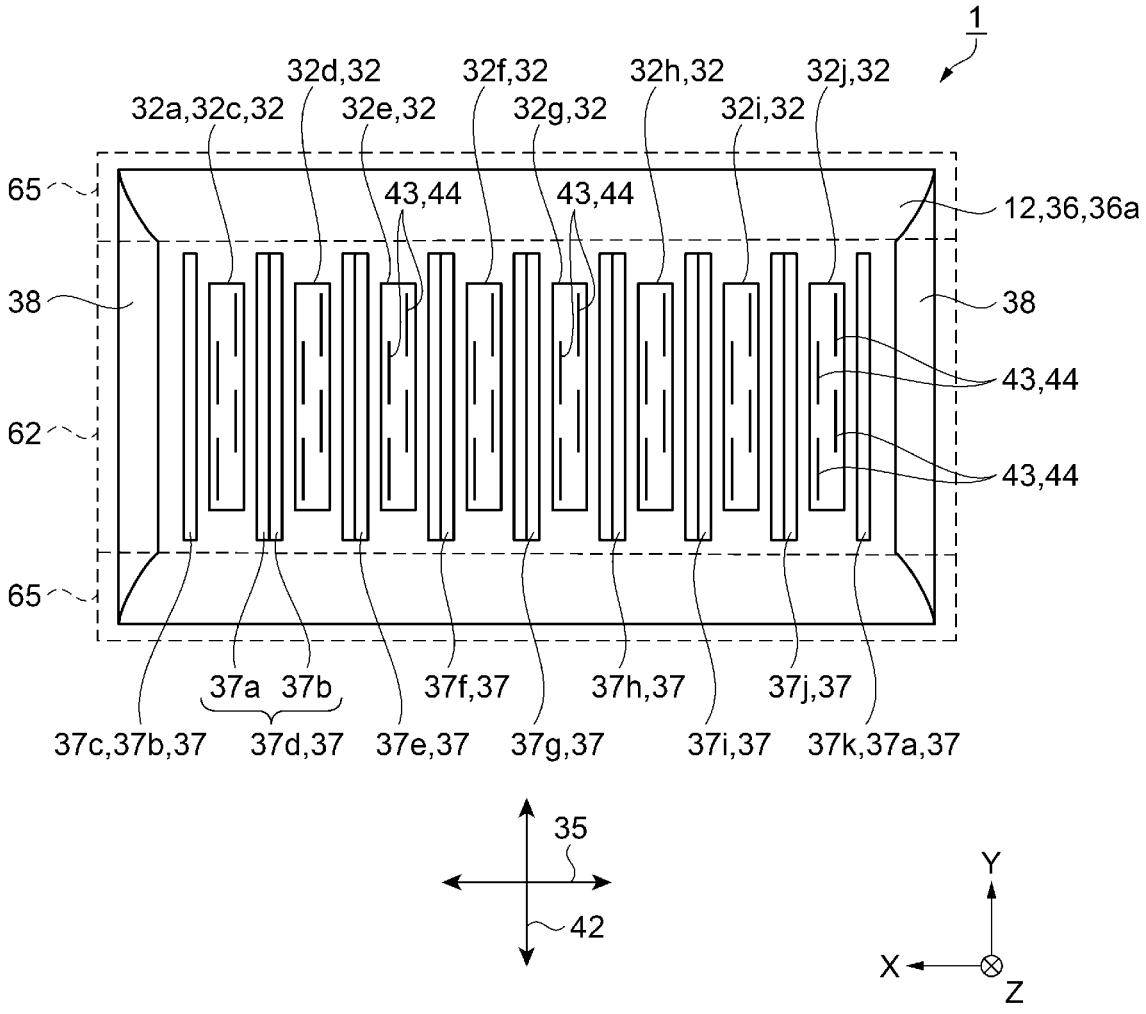
FIG. 4 is a schematic plan view illustrating the structure of the carriage.

FIG. 4 is a schematic plan view illustrating the structure of the carriage. As illustrated in FIG. 4, a central side of the current introducing portion 38 in the −X-axis direction is recessed in the +X-axis direction more deeply than the ±Y-axis direction sides. Then, the nozzle surface 32*a* is disposed on the +X-axis direction side of a place recessed in the +X-axis direction. Similarly, a central side of the current introducing portion 38 in the +X-axis direction is also recessed in the −X-axis direction more deeply than the ±Y-axis direction sides. Then, the nozzle surface 32*a* is disposed on the −X-axis direction side of a place recessed in the −X-axis direction. By means of the current introducing portions 38 having such shapes, air can flow from the ±Y-axis direction sides of the carriage 12 to the nozzle surface 32*a*.

A direction orthogonal to the first direction 35 in a plane parallel to the nozzle surface 32*a* will be referred to as a second direction 42. The nozzle surface 32*a* is shaped as a long rectangle in the second direction 42. Then, nozzles 43 are arranged in the second direction 42 to constitute a nozzle row 44. Note that a direction in which the nozzle row 44 extends may be any direction intersecting with the first direction 35, and is not limited to the second direction 42.

The head units 32 provided in the main body unit 36 include a first head unit 32*c*, a second head unit 32*d*, a third head unit 32*e*, a fourth head unit 32*f*, a fifth head unit 32*g*, a sixth head unit 32*h*, a seventh head unit 32*i*, and an eighth head unit 32*j* in this order from the +X-axis direction side to the −X-axis direction side. The plasma actuators 37 are disposed to sandwich the head units 32 in the first direction 35.

The plasma actuators 37 provided in the main body unit 36 include a first plasma actuator 37*c*, a second plasma actuator 37*d*, a third plasma actuator 37*e*, a fourth plasma actuator 37*f*, a fifth plasma actuator 37*g*, a sixth plasma actuator 37*h*, a seventh plasma actuator 37*i*, an eighth plasma actuator 37*j*, and a ninth plasma actuator 37*k* in this order from the +X-axis direction side to the −X-axis direction side.

Each of the plasma actuators 37 includes a + side plasma actuator 37*a* and a − side plasma actuator 37*b*. The + side plasma actuator 37*a* applies an air current in the +X-axis direction. Then, the − side plasma actuator 37*b* applies an air current in the −X-axis direction. The first plasma actuator 37*c* is the − side plasma actuator 37*b*.

When the carriage 12 travels in the +X-axis direction, the first plasma actuator 37*c* applies an air current to the first head unit 32*c*. The second plasma actuator 37*d* to the eighth plasma actuator 37*j* each include the + side plasma actuator 37*a* and the − side plasma actuator 37*b*. When the carriage 12 travels in the +X-axis direction, the − side plasma actuator 37*b* of the second plasma actuator 37*d* applies an air current to the second head unit 32*d*. Similarly, the − side plasma actuators 37*b* of the third plasma actuator 37*e* to the eighth plasma actuator 37*j* apply an air current to the third head unit 32*e* to the eighth head unit 32*j*, respectively.

When the carriage 12 travels in the −X-axis direction, the + side plasma actuator 37*a* of the second plasma actuator 37*d* applies an air current to the first head unit 32*c*. Similarly, the + side plasma actuators 37*a* of the third plasma actuator 37*e* to the eighth plasma actuator 37*j* apply an air current to the second head unit 32*d* to the seventh head unit 32*i*, respectively. The ninth plasma actuator 37*k* is the + side plasma actuator 37*a*. Then, the ninth plasma actuator 37*k* applies an air current to the eighth head unit 32*j*.

In this manner, the plasma actuators 37 are disposed to sandwich the head units 32 in the first direction 35. The carriage 12 moves back and forth in the first direction 35. Then, the plasma actuators 37 corresponding to the direction in which the carriage 12 travels relative to the head units 32 apply an air current to the head units 32.

The plasma actuators 37 disposed on the side toward which the carriage 12 travels relative to the head units 32 are different in the forward path and the return path in which the carriage 12 moves back and forth. Then, the plasma actuators 37 disposed on the side toward which the carriage 12 travels relative to the head units 32 apply an air current to the head units 32. Accordingly, during the movement of the carriage 12 in the forward path and also in the return path, the plasma actuators apply the air current in the direction identical to the travel direction of the first air current 41 generated as the carriage 12 moves, therefore the head units 32 can be passed through this air current.

Figure 5:
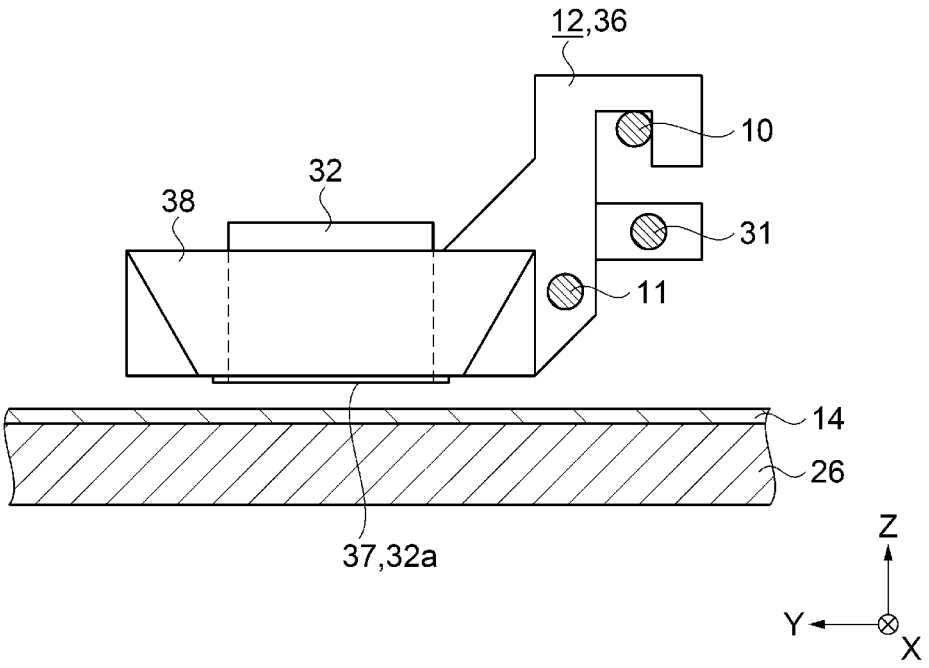
FIG. 5 is a schematic side view illustrating the structure of the carriage.
Figure 6:
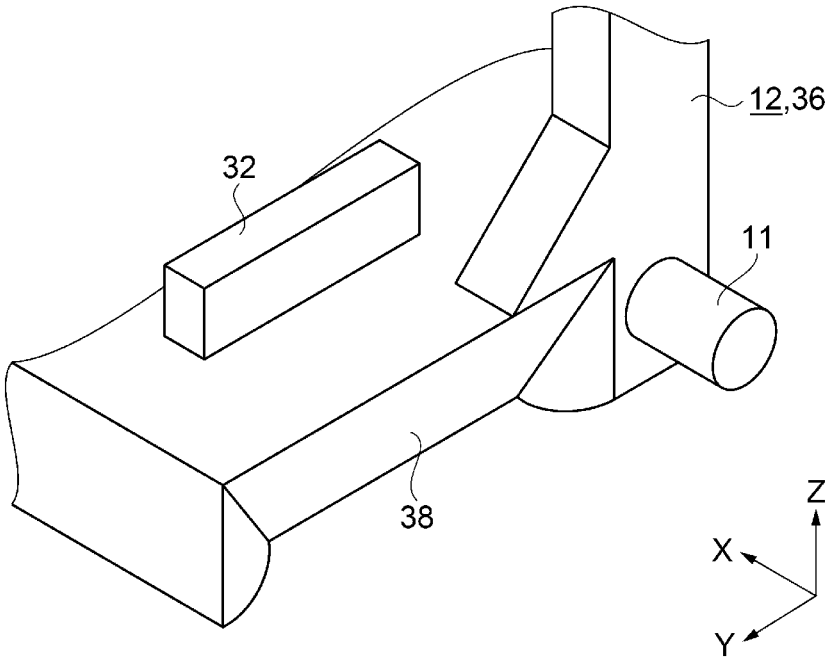
FIG. 6 is an overall perspective view illustrating main parts and a shape of a current introducing portion of the carriage.

FIG. 5 is a schematic side view illustrating the structure of the carriage, and FIG. 6 is an overall perspective view illustrating main parts and shapes of the current introducing portions of the carriage. As illustrated in FIGS. 5 and 6, the current introducing portions 38 are recessed in the X direction more deeply than the side surfaces of the main body unit 36. Then, the surfaces constituting each of the current introducing portions 38 include a curved surface, a flat surface, and the like formed continuously. Then, since the current introducing portions 38 are recessed deeply on the nozzle surface 32*a* sides, the current introducing portion 38 on the side corresponding to the direction in which the carriage 12 travels is capable of taking in air and causing the air to flow between the nozzle surface 32*a* and the recording medium 14.

Figure 7:
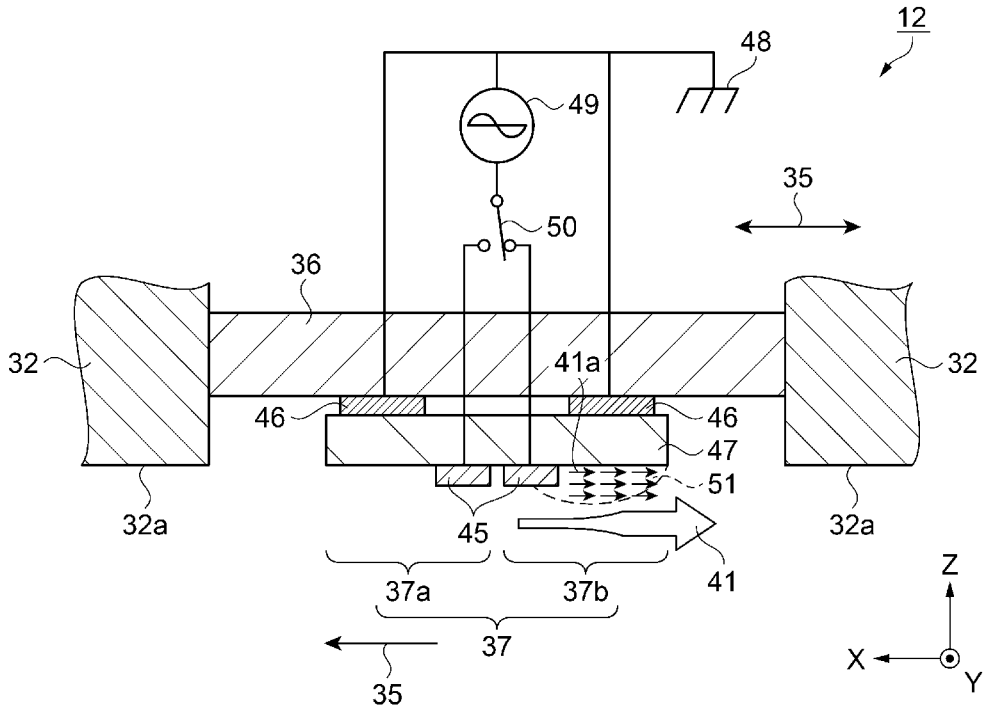
FIG. 7 is a schematic diagram for explaining operations of plasma actuators.
Figure 8:
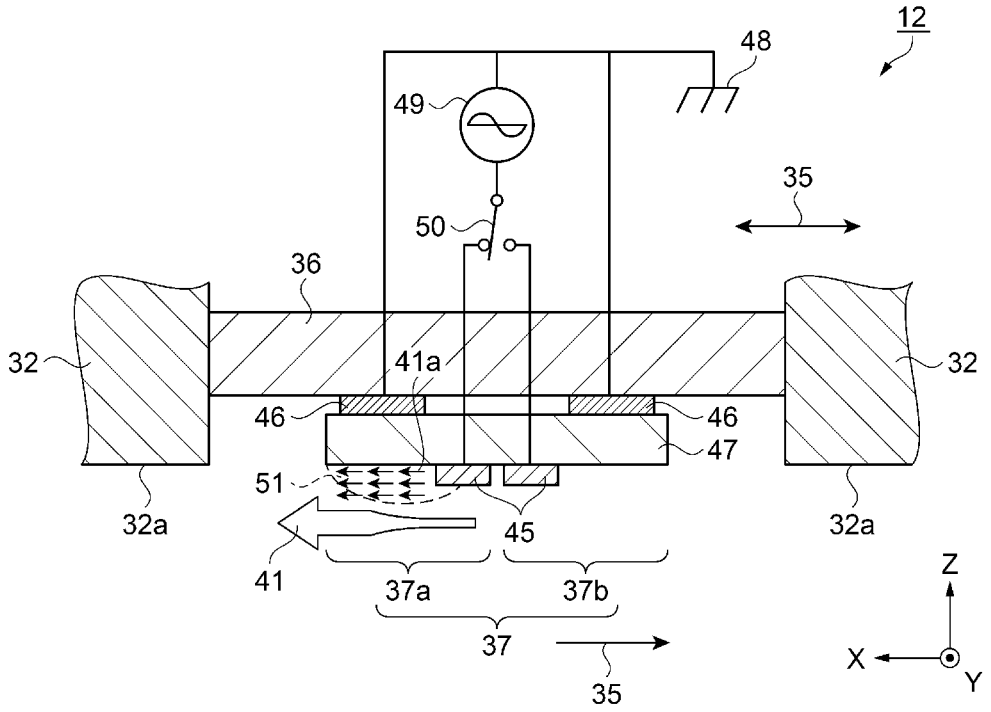
FIG. 8 is a schematic diagram for explaining operations of the plasma actuators.

FIGS. 7 and 8 are schematic diagrams for explaining operations of the plasma actuators. Since the operations of the plasma actuators 37 are known, general description of the operations of the plasma actuators 37 will be given without the detail. In FIG. 7, the travel direction of the carriage 12 is the +X-axis direction. In this case, the first air current 41 travels in the −X-axis direction. The plasma actuators 37 are each provided between the head units 32 adjacent to each other. Each of the plasma actuators 37 includes the + side plasma actuator 37*a* and the − side plasma actuator 37*b*. The + side plasma actuator 37*a* applies an air current 41*a* in the +X-axis direction. The − side plasma actuator 37*b* applies the air current 41*a* in the −X-axis direction.

The + side plasma actuator 37*a* and the − side plasma actuator 37*b* each include a lower electrode 45 and an upper electrode 46. Then, a dielectric member 47 is provided between the lower electrode 45 and the upper electrode 46. The lower electrode 45 and the upper electrode 46 are shaped in rectangles extending in the Y-axis direction, and are disposed parallel to each other. Then, when the − side plasma actuator 37*b* is viewed from the Z-axis direction side, the upper electrode 46 is disposed in the −X-axis direction of the lower electrode 45. When the + side plasma actuator 37*a* is viewed from the Z-axis direction side, the upper electrode 46 is disposed in the +X-axis direction of the lower electrode 45. A silicon plate, an epoxy plate, a Teflon (trade name) sheet, a polyimide sheet, or the like can be used as a plate material of the dielectric member 47. The lower electrode 45 and the upper electrode 46 may be any conductive material, and the material is not particularly limited, and a metal such as silver, copper, and aluminum can be used.

The upper electrode 46 is grounded by a chassis ground 48. Then, an AC power source 49 and a switch 50 are connected in series between the upper electrode 46 and the lower electrode 45. The AC power source 49 has a voltage of several Kv and a frequency of several KHz. The switch 50 switches a voltage supplied by the AC power source 49 to one of the + side plasma actuator 37*a* and the − side plasma actuator 37*b*.

When the carriage 12 travels in the +X-axis direction, the control unit 6 drives the − side plasma actuator 37*b*. Then, the control unit 6 switches a circuit of the switch 50 to supply an AC voltage to the lower electrode 45 of the − side plasma actuator 37*b*. In this case, an AC magnetic field is formed between the lower electrode 45 and the upper electrode 46. This AC magnetic field forms discharge plasma on the −X-axis direction side of the lower electrode 45 of the − side plasma actuator 37*b*. A region where this discharge plasma is formed will be referred to as a plasma region 51.

Distribution of electrons accumulated in the lower electrode 45 and electrons accumulated on a surface of the −Z-axis direction side of the dielectric member 47 differs depending on whether a voltage of the lower electrode 45 rises or falls. Then, an ionization state of air in the plasma region 51 becomes asymmetrical between a case where a voltage of the lower electrode 45 rises and a case where a voltage of the lower electrode 45 falls. For this reason, momentum biased in the −X-axis direction is produced in air. Note that normally, less than 1 ppm of air is ionized in the plasma region 51. A small number of accelerated charged particles collide with the remaining large number of neutral air molecules and produce macro momentum.

In this manner, when electrons and ions move between the lower electrode 45 and the dielectric member 47, the electrons and ions collide with air molecules, and the air molecules move in the −X-axis direction. Thus, the − side plasma actuator 37*b* applies the air current 41*a* flowing in the −X-axis direction along the nozzle surface 32*a* to the first air current 41.

As illustrated in FIG. 8, when the carriage 12 travels in the −X-axis direction, the control unit 6 drives the − side plasma actuator 37*a*. Then, the control unit 6 switches the circuit of the switch 50 to supply an AC voltage to the lower electrode 45 of the + side plasma actuator 37*a*. In this case, an AC magnetic field is formed between the lower electrode 45 and the upper electrode 46. This AC magnetic field forms discharge plasma on the +X-axis direction side of the lower electrode 45 of the + side plasma actuator 37*a*.

Then, when electrons and ions move between the lower electrode 45 and the dielectric member 47, the electrons and ions collide with air molecules, and the air molecules move in the +X-axis direction. Thus, the + side plasma actuator 37*a* applies the air current 41*a* flowing in the +X-axis direction along the nozzle surface 32*a* to the first air current 41.

Figure 9:
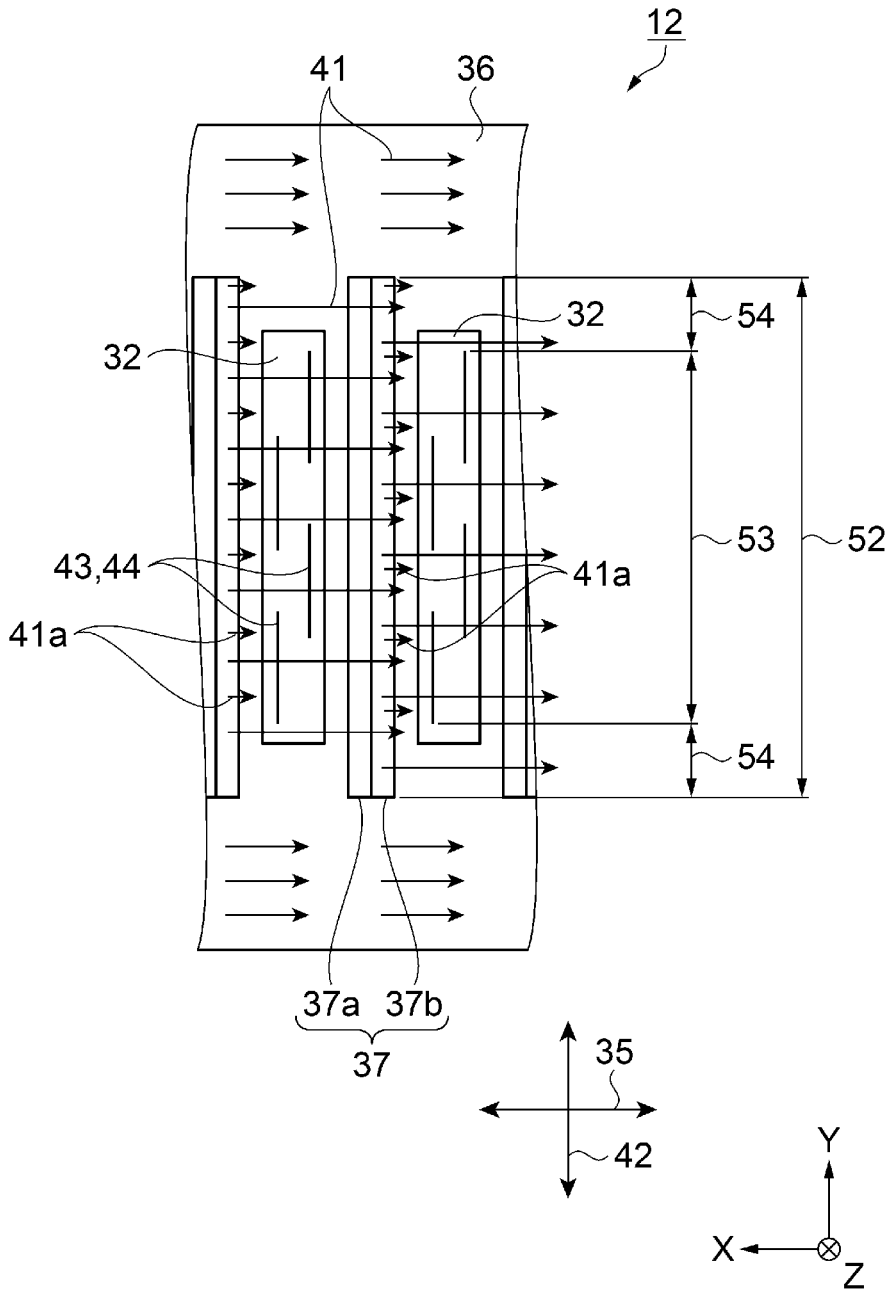
FIG. 9 is a schematic plan view illustrating main parts of a bottom surface of the carriage.

FIG. 9 is a schematic plan diagram illustrating main parts of a bottom surface of the carriage, and is a diagram illustrating the carriage 12 traveling in the +X-axis direction. As illustrated in FIG. 9, the nozzle row 44 is arranged extending in the second direction 42. Then, the plasma actuators 37 also have shapes extending in the second direction 42. The range where the plasma actuators 37 apply the air current 41*a* to the first air current 41 will be referred to as a first range 52.

Then, the range where the nozzle row 44 is provided in each of the head units 32 will be referred to as a second range 53. The second range 53 is a smaller range than the first range 52. Accordingly, the first range 52 also includes places where the nozzles 43 are not provided at both ends of the second range 53. The places in the first range 52 where the nozzles 43 are not disposed will be referred to as third ranges 54. The third ranges 54 are disposed at both the ends of the second range 53. In other words, the range where the plasma actuators 37 apply the air current 41*a* in the second direction 42 also includes places where the nozzles 43 are not provided at the nozzle row 44 and the ends of the nozzle row 44.

Thus, the plasma actuators 37 apply the air current 41*a* to the first air current 41 located at the second range 53 where the nozzle row 44 is provided. Further, the plasma actuators 37 also apply the air current 41*a* to the first air current 41 located at the third ranges 54 where the nozzles 43 are not provided at the ends of the nozzle row 44. For this reason, the first air current 41 also flows at the ends of the nozzle row 44 at a similar rate to a rate in the middle of the nozzle row 44.

Figure 10:
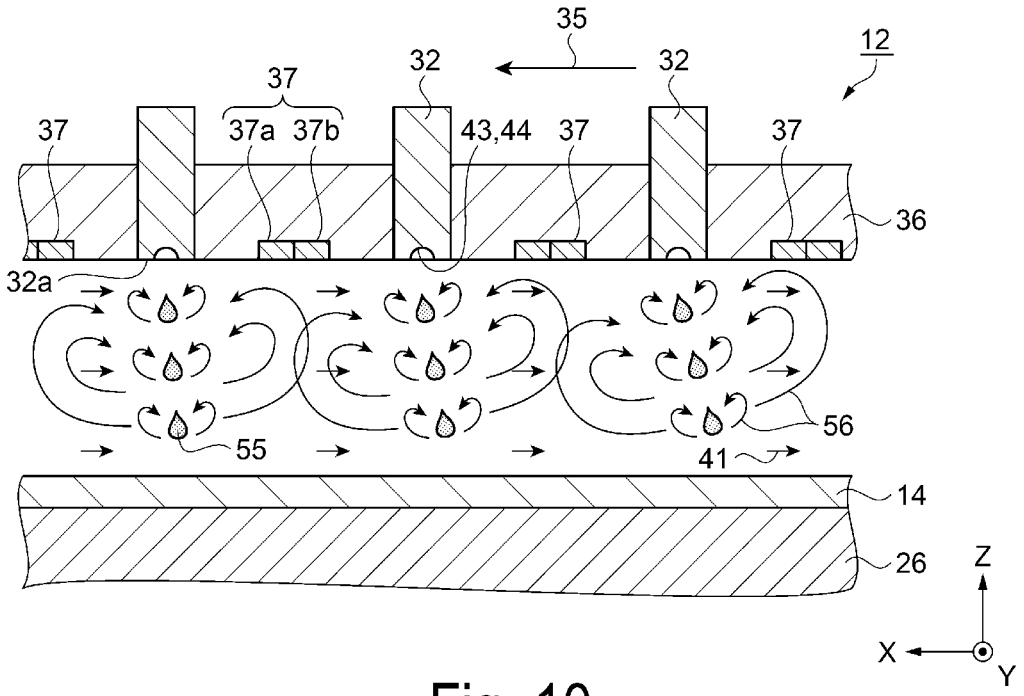
FIG. 10 is a schematic diagram for explaining an effect that a first air current has on a second air current generated by ejection of ink droplets.
Figure 11:
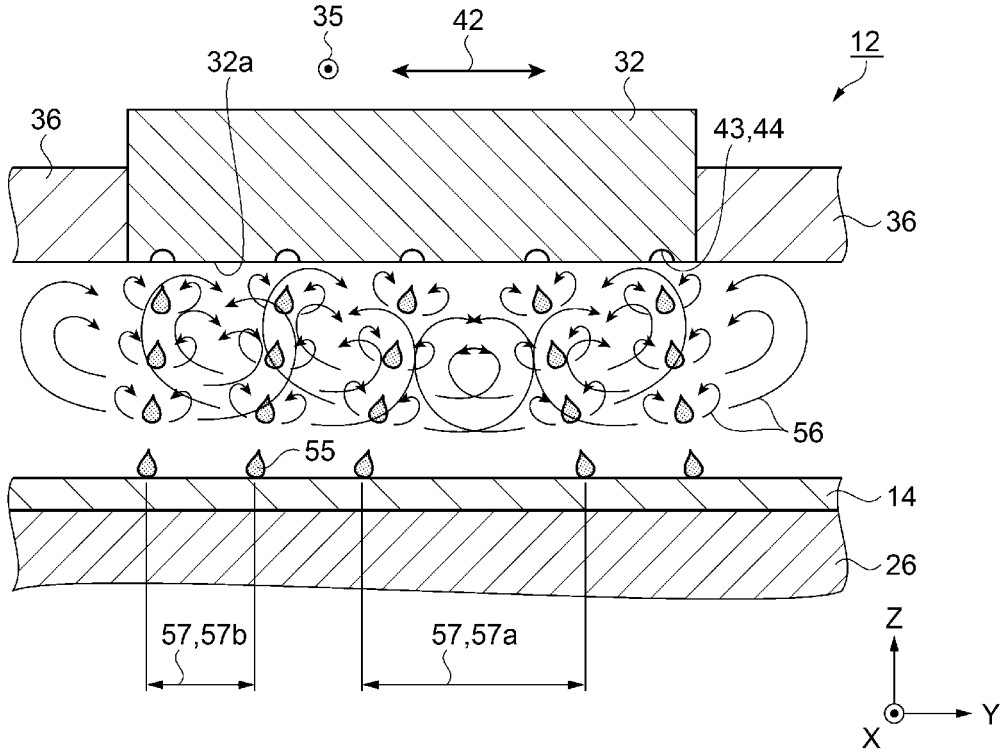
FIG. 11 is a schematic diagram for explaining an effect that the first air current has on the second air current generated by ejection of ink droplets.

FIGS. 10 to 13 are schematic diagrams for explaining an effect that the first air current has on a second air current generated by ejection of ink droplets. FIGS. 10 and 11 each illustrate a state where the plasma actuators 37 are not driven. FIG. 10 is a diagram illustrating the carriage 12 from the Y-axis direction side, and FIG. 11 is a diagram illustrating the carriage 12 from the X-axis direction side. As illustrated in FIG. 10, the nozzles 43 are provided on the nozzle surface 32*a* of each head unit 32. Note that the number of nozzle rows 44 and the number of the nozzles 43 in each head unit 32 are reduced to make the drawing more understandable. Then, ink droplets 55 are ejected from the nozzles 43. Since the carriage 12 moves in the first direction 35 relative to the platen 26, the ink droplets 55 are observed in the first direction 35 as traveling at a slight angle relative to a vertical direction.

When the ink droplets 55 ejected from the nozzles 43 travel, an air current is generated as the ink droplets 55 travel. This air current will be referred to as a second air current 56. As an ejection rate of the ink droplets 55 increases, turbulence is generated in the second air current 56 in the peripheries of the ink droplets 55. Then, a vortex-shaped rotational flow is generated in the second air current 56. Thus, since the second air current 56 also affects places distant from the ink droplets 55, the second air current 56 becomes turbulence. Then, the turbulence in the second air current 56 deviates a travel direction of the ink droplets 55.

As illustrated in FIG. 11, the turbulence in the second air current 56 generates a place where a gap 57 between places where the ink droplets 55 land on the recording medium 14 is a first gap 57*a* having a great width, and a place where the gap 57 is a second gap 57*b* having a small width. When the head units 32 travel in the first direction 35 with the first gap 57*a* and the second gap 57*b* remaining in this manner, the ink droplets 55 landing on the recording medium 14 form a ripple-like pattern.

Figure 12:
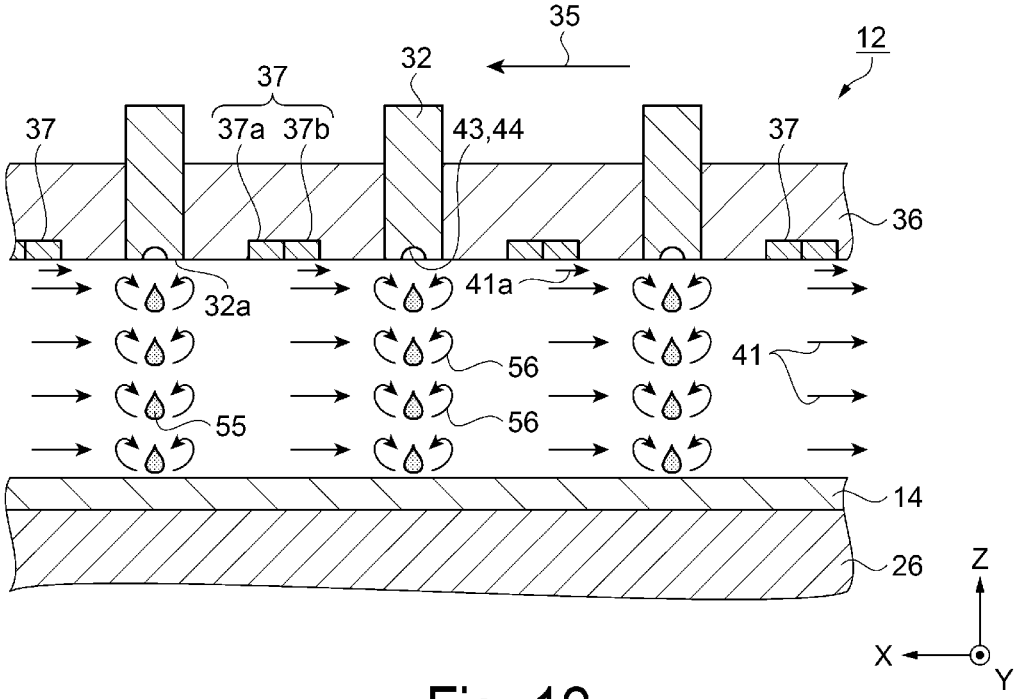
FIG. 12 is a schematic diagram for explaining an effect that the first air current has on the second air current generated by ejection of ink droplets.
Figure 13:
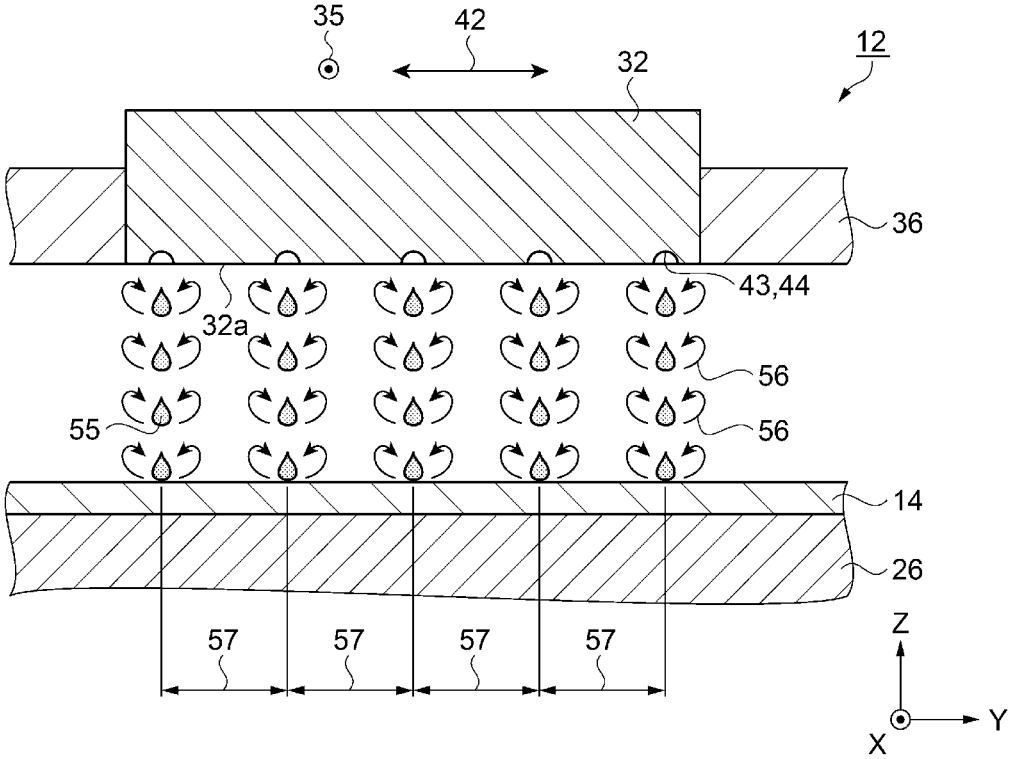
FIG. 13 is a schematic diagram for explaining an effect that the first air current has on the second air current generated by ejection of ink droplets.

FIGS. 12 and 13 each illustrate a state where the − side plasma actuator 37*b* is driven. FIG. 12 is a diagram illustrating the carriage 12 from the Y-axis direction side, and FIG. 13 is a diagram illustrating the carriage 12 from the X-axis direction side. As illustrated in FIG. 12, the − side plasma actuator 37*b* is driven. Then, the − side plasma actuator 37*b* applies the air current 41*a* to the first air current 41 flowing along the nozzle surface 32*a*. The first air current 41 affects the turbulence in the second air current 56 traveling in the travel direction of the ink droplets 55, and prevents the turbulence in the second air current 56 occurring in the peripheries of the ink droplets 55 from stagnating. Accordingly, the plasma actuators 37 are capable of preventing the ink droplets 55 traveling from being affected by the turbulence in the second air current 56.

As illustrated in FIG. 13, the turbulence in the second air current 56 is prevented, and thus, a variation in the gap 57 between the places where the ink droplets 55 land on the recording medium 14 reduces. When the head units 32 travel in the first direction 35 in a state where a variation in the gap 57 is reduced in this manner, the ink droplets 55 landing on the recording medium 14 are prevented from forming a ripple-like pattern.

Figure 14:
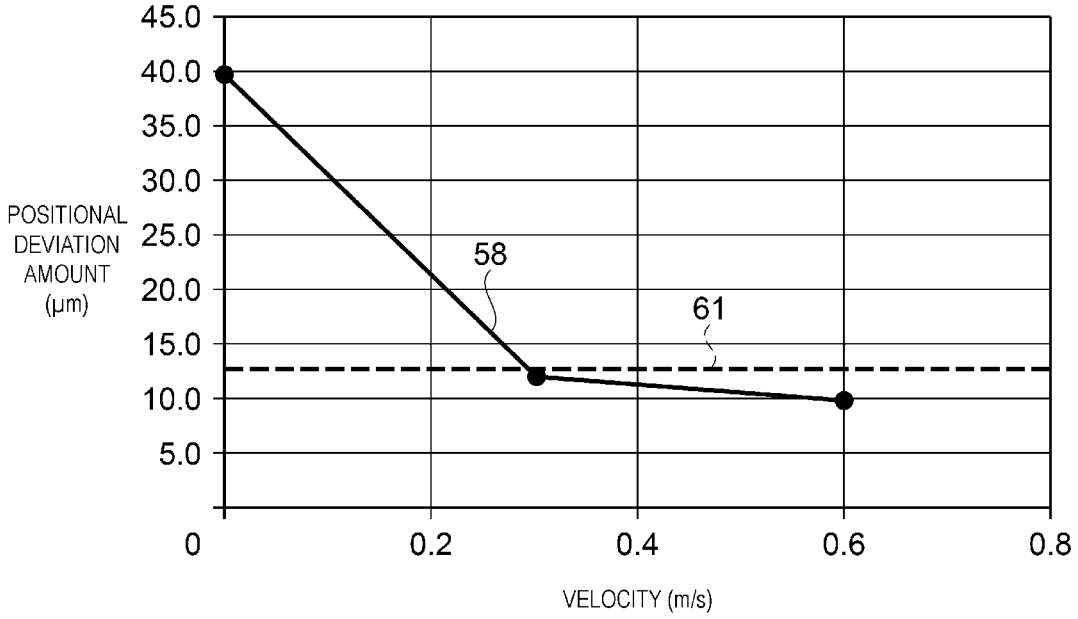
FIG. 14 is a graph illustrating a relationship between a velocity of the first air current and a positional deviation amount in a Y-direction of ink droplets landing on a recording medium.

FIG. 14 is a graph illustrating a relationship between a velocity of the first air current and a positional deviation amount in the Y-direction of the ink droplets landing on the recording medium. The ink droplets 55 are ejected from the nozzles 43 without movement of the carriage 12. In this case, a difference between positions where the ink droplets 55 land on the recording medium 14 and positions directly below the nozzles 43 is the positional deviation amount. A horizontal axis represents the velocity of the first air current 41, and a vertical axis represents the positional deviation amount of the places where the ink droplets 55 land. A velocity-positional deviation correlation line 58 indicates the positional deviation amount with respect to the velocity of the first air current 41.

The positional deviation amount is approximately 40 μm when the velocity of the first air current 41 is 0 m/S. The positional deviation amount decreases to approximately 12 μm when the velocity of the first air current 41 is 0.3 m/S. The positional deviation amount decreases to approximately 10 μm when the velocity of the first air current 41 is 0.6 m/S. A ripple observance line 61 represents a boundary at which a ripple is confirmed. A ripple is confirmed when the positional deviation amount is greater than or equal to 13 μm. Accordingly, the positional deviation amount may be less than the ripple observance line 61.

The positional deviation amount is close to the ripple observance line 61 when the velocity of the first air current 41 is 0.3 m/S. When an average velocity of the first air current 41 is 0.3 m/S, the velocity may drop below 0.3 m/S. For this reason, a ripple is likely to be observed. Accordingly, the velocity of the first air current 41 may be greater than or equal to 0.6 m/S.

With reference to FIG. 9 again, the air current 41*a* occurring by the plasma actuators 37 is applied to the first air current 41 in the second range 53 and also in the third ranges 54. As a result, the ink droplets 55 traveling are prevented from being affected by the turbulence in the second air current 56, as with in the middle of the nozzle row 44.

With reference to FIG. 4 again, a region on the air current surface 36*a* where the head units 32 and the plasma actuators 37 are provided will be referred to as a first region 62. The nozzles 43 are provided in the first region 62, and at least one of a plurality of concave portions or a plurality of convex portions are further disposed in the first region 62.

Figure 15:
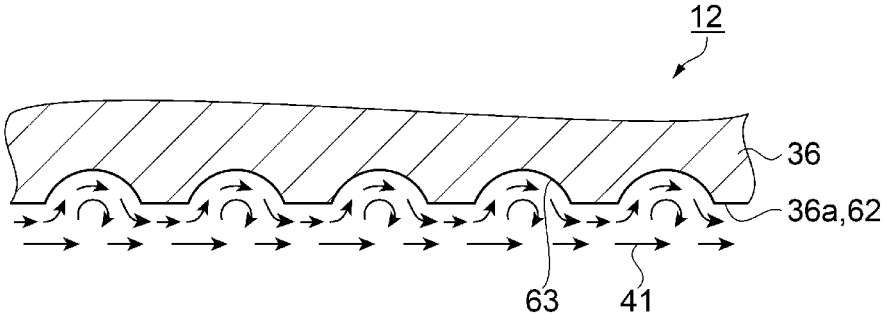
FIG. 15 is a schematic side cross-sectional diagram for explaining an action of concave portions provided on an air current surface.

FIG. 15 is a schematic side cross-sectional diagram for explaining an action of the concave portions provided on the air current surface. As illustrated in FIG. 15, when concave portions 63 are provided on the air current surface 36*a* in the first region 62, some of the first air current 41 flowing along the air current surface 36*a* flows along the concave portions 63, and some of the first air current 41 travels straight. In this case, the air current flowing along the concave portions 63 and the air current traveling straight interfere and generate fine turbulence. Fluid body resistance in the air current surface 36*a* is reduced by this turbulence. As a result, the first air current 41 flows efficiently.

Figure 16:
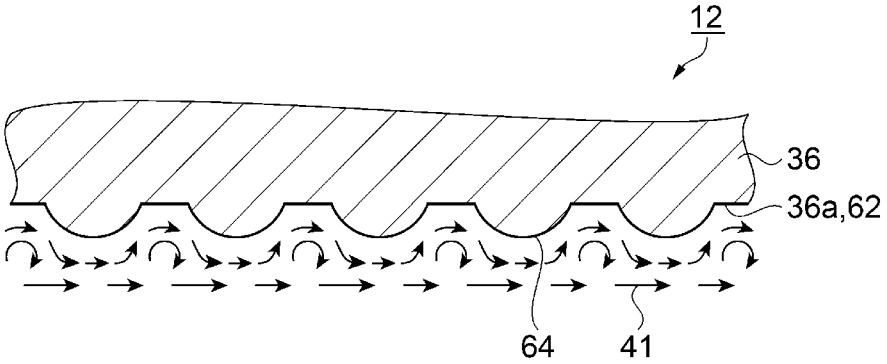
FIG. 16 is a schematic side cross-sectional diagram for explaining an action of convex portions provided on the air current surface.

FIG. 16 is a schematic side cross-sectional diagram for explaining an action of the convex portions provided on the air current surface. As illustrated in FIG. 16, when convex portions 64 are provided on the air current surface 36*a* in the first region 62, some of the first air current 41 flowing along the air current surface 36*a* flows along the convex portions 64, and some of the first air current 41 travels straight. In this case, the air current flowing along the convex portions 64 and the air current traveling straight interfere and generate fine turbulence. Fluid body resistance in the air current surface 36*a* is reduced by this turbulence. As a result, the first air current 41 flows efficiently. Note that either the concave portions 63 or the convex portions 64 may be arranged in the first region 62, or both the concave portions 63 and the convex portions 64 may be provided in the first region 62. Fluid body resistance in the air current surface 36*a* is also reduced by this turbulence in this case. As a result, the first air current 41 flows efficiently.

With reference to FIG. 4 again, regions on the +Y-axis direction side and the −Y-axis direction side of the first region 62 will be referred to as second regions 65. The second regions 65 are disposed to sandwich the first region 62 in the second direction 42. Then, neither the concave portions 63 nor the convex portions 64 are disposed in the second regions 65. Thus, the first air current flows more efficiently in the first region 62 than in the second regions 65.

Then, the second regions 65 are disposed to sandwich the first region 62 in the second direction 42. Thus, when the carriage 12 moves in the first direction 35, a direction in which the first air current 41 flows is controlled to cause the first air current 41 flowing in the first region 62 to flow in the first direction 35 without flowing toward the second regions 65.

Then, the nozzles 43 are provided in the first region 62. Accordingly, the first air current 41 entering the first region 62 passes along the nozzle surface 32*a* efficiently.

According to the first exemplary embodiment as described above, there are the following effects.

According to the first exemplary embodiment, the carriage 12 includes the head units 32 and the plasma actuators 37. Each of the head units 32 includes the nozzle surface 32*a* provided with the nozzles 43, and the ink droplets 55 are ejected from the nozzles 43. The plasma actuators 37 apply the air current 41*a* to the first air current 41 flowing along the nozzle surface 32*a*.

When the ink droplets 55 ejected from the nozzles 43 travel, the second air current 56 is generated as the ink droplets 55 travel. As the ejection rate of the ink droplets 55 increases, turbulence is generated in the second air current 56 in the peripheries of the ink droplets 55. The turbulence in the second air current 56 disturbs the travel direction of the ink droplets 55. When the ink droplets 55 are affected by the turbulence in the second air current 56, the ink droplets 55 landing on the recording medium 14 form a ripple-like pattern.

The plasma actuators 37 apply the air current 41*a* to the first air current 41 flowing along the nozzle surface 32*a*. The first air current 41 affects the turbulence in the second air current 56 traveling in the travel direction of the ink droplets 55, and prevents the turbulence in the second air current 56 occurring in the peripheries of the ink droplets 55 from stagnating. Accordingly, the ink droplets 55 traveling are prevented from being affected by the turbulence in the second air current 56. As a result, the carriage 12 is capable of preventing the ink droplets 55 landing on the recording medium 14 from forming a ripple-like pattern.

According to the first exemplary embodiment, the carriage 12 moves in the first direction 35. Then, the nozzles 43 are arranged in the second direction 42 intersecting with the first direction 35, and constitutes the nozzle row 44. Accordingly, the nozzle row 44 extends in the second direction 42. The plasma actuators 37 are longer in the second direction 42 than the nozzle row 44. Then, the nozzle row 44 is located within the first range 52 where the plasma actuators 37 apply the air current 41*a*. Further, the first range 52 where the plasma actuators 37 apply the air current 41*a* to the first air current also includes the third ranges 54 where the nozzles 43 are not provided at the ends of the nozzle row 44.

The plasma actuators 37 apply the air current 41*a* to the first air current 41 located in the second range 53 where the nozzle row 44 is provided. Further, the plasma actuators 37 also apply the air current 41*a* to the first air current located in the third ranges 54 where the nozzles 43 are not provided at the ends of the nozzle row 44. For this reason, the first air current 41 flows at the ends of the nozzle row 44 as quickly as in the middle of the nozzle row 44. As a result, the ink droplets 55 traveling are also prevented from being affected by the turbulence in the second air current 56 at the ends of the nozzle row 44, as with in the middle of the nozzle row 44.

According to the first exemplary embodiment, the carriage 12 moves back and forth in the first direction 35. When the carriage 12 moves, the first air current 41 travels from the travel direction side of the carriage 12 to the head units 32. Then, the plasma actuators 37 are disposed to sandwich each head unit 32 in the first direction 35. The plasma actuators 37 disposed on the side toward which the carriage 12 travels relative to the head units 32 are different in the forward path and the return path. Then, the plasma actuators 37 disposed on the sides toward which the carriage 12 travels relative to the head units 32 apply the air current 41*a*. Accordingly, during the movement of the carriage 12 in the forward path and also in the return path, the head units 32 are caused to pass through the air current 41*a* applied by the plasma actuators 37 in the direction identical to the travel direction of the first air current 41 generated as the carriage 12 moves.

According to the first exemplary embodiment, the carriage 12 includes the main body unit 36 configured to support the head units 32 and the plasma actuators 37. Then, a gas flowing along the nozzle surface 32*a* flows along the air current surface 36*a* of the main body unit 36. The plurality of concave portions 63 or the plurality of convex portions 64 are disposed in the air current surface 36*a*. Some of the first air current 41 flowing along the air current surface 36*a* flows along the concave portions 63 or the convex portions 64, and some of the first air current 41 travels straight. In this case, the first air current 41 flowing along the concave portions 63 or the convex portions 64 and the first air current 41 traveling straight interfere each other and generate fine turbulence. Fluid body resistance in the air current surface 36*a* is reduced by this turbulence. As a result, the first air current 41 can flow more efficiently.

According to the first exemplary embodiment, the main body unit 36 of the carriage 12 includes the first region 62 and the second regions 65. At least either the plurality of concave portions 63 or the plurality of convex portions 64 are disposed in the first region 62. Then, neither the concave portions 63 nor the convex portions 64 are disposed in the second regions 65. Thus, the first air current 41 flows more efficiently in the first region 62 than in the second regions 65.

Then, the second regions 65 are disposed to sandwich the first region 62 in the second direction 42 intersecting with the first direction 35 in which the carriage 12 moves. When the carriage 12 moves in the first direction 35, the direction in which the first air current 41 flows can be so controlled that the first air current 41 flowing in the first region 62 flows in the first direction 35 without flowing toward the second regions 65.

Then, the nozzles 43 are arranged in the first region 62. Accordingly, the first air current 41 entering the first region 62 can pass along the nozzle surface 32*a* more efficiently.

According to the first exemplary embodiment, the main body unit 36 is provided with the current introducing portions 38 in the first direction 35 in which the carriage 12 moves. Then, the current introducing portions 38 move air located on the side corresponding to the direction in which the carriage 12 moves. Then, the moved air becomes the first air current 41 flowing along the nozzle surface 32*a*. Accordingly, the current introducing portions 38 are capable of taking in the first air current 41 efficiently as the carriage 12 moves.

According to the first exemplary embodiment, the recording apparatus 1 includes the carriage 12. The carriage 12 is the carriage 12 capable of preventing the ink droplets 55 landing on the recording medium 14 from forming a ripple-like pattern. Accordingly, the recording apparatus 1 is implemented as the recording apparatus 1 including the carriage 12 capable of preventing the ink droplets 55 landing on the recording medium 14 from forming a ripple-like pattern.

Note that the first exemplary embodiment is not limited to the exemplary embodiments described above. Many variations and modifications can also be made by one of ordinary skill in the art within the technical spirit of the disclosure. Modified examples will be described below.

Modified Example 1

In the first exemplary embodiment, the nozzle row 44 is located within the range where the plasma actuators 37 apply the air current 41*a* in the second direction 42. When the ink droplets 55 landing on the recording medium 14 and present in a place facing a portion at the end of the nozzle row 44 do not form a ripple-like pattern, the portion at the end of the nozzle row 44 may not be located within the range where the plasma actuators 37 apply the air current 41*a* in the second direction 42. In other words, the plasma actuators 37 may not be provided in a place where a ripple-like pattern is not formed. Since the length in the second direction 42 of each of the plasma actuators 37 is reduced, the weight of the carriage 12 is reduced.

Modified Example 2

In the first exemplary embodiment, the carriage 12 moves back and forth in the first direction 35. The plasma actuators 37 are disposed to sandwich each head unit 32 in the first direction 35. When the direction in which the carriage 12 moves as the ink droplets 55 are ejected from the nozzles 43 is one direction, each of the plasma actuators 37 may be disposed on one side in the first direction 35 of each head unit 32. Then, the plasma actuators 37 may be disposed on the sides of the head units 32 corresponding to the direction in which the head units 32 move as the ink droplets 55 are ejected. In this case, similarly, the plasma actuators 37 are capable of applying the air current 41*a* along the nozzle surface 32*a*. Then, since the number of the plasma actuators 37 is reduced, the weight of the carriage 12 is reduced.

Modified Example 3

In the first exemplary embodiment, the concave portions 63 or the convex portions 64 are provided in the first region 62 of the main body unit 36. In a case where a ripple-like pattern is not formed on the recording medium 14 even when the concave portions 63 or the convex portions 64 are not provided in the first region 62, the concave portions 63 and the convex portions 64 may be omitted. Since the concave portions 63 and the convex portions 64 are not provided, the recording apparatus 1 is manufactured with high productivity.

Modified Example 4

In the first exemplary embodiment, the current introducing portions 38 are provided in the main body unit 36. In a case where a ripple-like pattern is not formed on the recording medium 14 even when the current introducing portions 38 are not provided, the current introducing portions 38 may be omitted. Since the current introducing portions 38 are not provided, the recording apparatus 1 is manufactured with high productivity.

This application claims priority under 35 U.S.C. § 119 to Japanese Patent Application No. 2017-140629, filed Jul. 20, 2017. The entire disclosure of Japanese Patent Application No. 2017-140629 is hereby incorporated herein by reference.

What is claimed is:

1. A carriage comprising:

a head including a nozzle surface, the nozzle surface including nozzles configured to eject ink droplets;

a plasma actuator configured to apply an air current flowing along the nozzle surface; and a main body unit configured to support the head and the plasma actuators, wherein at least either a plurality of concave portions or a plurality of convex portions are disposed on an air current surface that is a surface on which a gas flows along the nozzle surface in the main body unit.

2. The carriage according to claim 1, wherein the nozzles are arranged in a second direction intersecting with a first direction in which the carriage travels, to constitute a nozzle row, and places where the nozzles are not provided at the nozzle row and the ends of the nozzle row are included within a range where the plasma actuators apply the air current in the second direction.

3. The carriage according to claim 2, wherein the carriage moves back and forth in the first direction, and the plasma actuators are disposed to sandwich the head in the first direction, and the plasma actuators disposed on a side toward which the carriage travels apply the air current to the head.

4. The carriage according to claim 1, wherein the carriage moves back and forth in the first direction, and the plasma actuators are disposed to sandwich the head in the first direction, and the plasma actuators disposed on a side toward which the carriage travels apply the air current to the head.

5. The carriage according to claim 4, further comprising:

a main body unit configured to support the head and the plasma actuators, wherein at least either a plurality of concave portions or a plurality of convex portions are disposed on an air current surface that is a surface on which a gas flows along the nozzle surface in the main body.

6. The carriage according to claim 1, wherein the air current surface includes:

a first region in which at least either the plurality of concave portions or the plurality of convex portions are disposed; and second regions in which neither the concave portions nor the convex portions are disposed, the second regions are disposed to sandwich the first region in a second direction intersecting with a first direction in which the carriage travels, and the nozzles are provided in the first region.

7. The carriage according to claim 6, wherein the main body unit includes a current introducing portion configured to guide the air current flowing along the nozzle surface in the first direction in which the carriage travels.

8. The carriage according to claim 1, wherein the main body unit includes a current introducing portion configured to guide the air current flowing along the nozzle surface in the first direction in which the carriage travels.

9. A recording apparatus comprising a carriage, the carriage including:

a head including a nozzle surface, the nozzle surface including nozzles configured to eject ink droplets; a plasma actuator configured to apply an air current flowing along the nozzle surface; and a main body unit configured to support the head and the plasma actuators, wherein at least either a plurality of concave portions or a plurality of convex portions are disposed on an air current surface that is a surface on which a gas flows along the nozzle surface in the main body unit.

* * * * *